US005165257A

United States Patent [19]

Corenblith

[11] Patent Number: 5,165,257

[45] Date of Patent: Nov. 24, 1992

[54] ADJUSTABLE BUTTON CLASP

[76] Inventor: Arthur J. Corenblith, 3322 Cloverdale, Houston, Tex. 77025

[21] Appl. No.: 700,472

[22] Filed: May 15, 1991

[51] Int. Cl.[5] ..... A47C 13/00; A47C 9/00

[52] U.S. Cl. ..... 63/1.1; 63/15

[58] Field of Search ..... 63/1.1, 15, 15.8, 20, 63/29.1, 29.2

[56] References Cited

U.S. PATENT DOCUMENTS

| | | | |
|---|---|---|---|
| 389,778 | 9/1888 | Thie | 63/29.1 |
| 643,053 | 2/1900 | Halfmann | 63/1.1 |
| 1,109,403 | 9/1914 | Davidson | 63/29.1 |
| 2,221,759 | 11/1940 | Erard | 63/20 |
| 2,274,269 | 2/1942 | Jellinek | 63/1.1 |
| 3,192,737 | 7/1965 | Schechter et al. | 63/1.1 |
| 3,348,388 | 10/1967 | Elliott | 63/1.1 |
| 3,639,949 | 2/1972 | Beck | 63/29.1 |
| 3,959,989 | 6/1976 | Bhandia | 63/1.1 |
| 4,427,130 | 1/1984 | Szigeti | 63/1.1 |
| 4,982,580 | 1/1991 | Otenbaker | 63/29.1 |

*Primary Examiner*—Renee S. Luebke

*Assistant Examiner*—Michael Milano

*Attorney, Agent, or Firm*—Mark M. Friedman; Benjamin J. Barish

[57] ABSTRACT

A device for effecting the detachable mounting of a ornament, such as a display button having a pin, onto a piece of jewelry, typically a ring. A piece of jewelry such as an expensive ring is modified so as to include a device which includes side walls protruding substantially perpendicularly away from the ring. The side walls include one or more pairs of opposing perforations through which one can pass a pin of an ornament, such as a display button, so as to mount the ornament or button onto the ring. The ornament of button can be detached and changed at will. Further embodiments include a cover plate to form an enclosed space into which a plastic or rubber can be injected to stabilize the pin and fix its position and orientation. A further modification involves the use of elongated slots to facilitate the location of the pin so as to cause the cover plate to be in contact with the back surface of the button so as to further stabilize it.

12 Claims, 2 Drawing Sheets

ADJUSTABLE BUTTON CLASP

BACKGROUND OF THE INVENTION

1. Field of the Invention

This invention relates to a modification of a jewelry item which allows the jewelry item to accommodate interchangeable buttons or ornaments, and, more particularly, to a modification of a ring, an earring, a bracelet, or other jewelry item which enables a button or ornament to be detachably mounted onto the piece of jewelry.

2. Description of the Background Art

The wearer of jewelry and other ornamental items, whether constructed of expensive precious metals and gems or inexpensive costume jewelry, often wishes to vary the appearance of these items. The desired variety can be achieved by owning a number of jewelry items, for example, several different rings, and periodically changing the ring being worn. The disadvantage of this approach is that the user is obligated to invest in a series of jewelry items which, for the most part, lie idly in the jewelry box and are only occasionally worn.

An alternative approach is to vary the appearance of a jewelry item by detachably connecting to the jewelry item an ornamental member which alters the appearance of the overall item.

One example of this approach is disclosed in U.S. Pat. No. 3,345,388 which teaches a bracelet capable of accommodating interchangeable brooches. Another example is disclosed in U.S. Pat. No. 3,639,949 which teaches a scarf clip which includes a base provided on its front surface with resilient clips or magnetic studs to retain a fastening pin of a brooch or similar ornament which can be interchangeably supported thereby.

In both cases, the systems disclosed fail to prevent the pin, constituting the securing member of the brooch or other ornament from translating along its axis or from twisting or turning about its axis. Thus, there is little to prevent the brooch or other ornamental member from changing its orientation while connected to the bracelet or the scarf clip.

It would be desirable to have means which would make it possible to attach to a jewelry item a pin-mounted ornament such as a button displaying political, inspirational, or advertising message, which would allow the button to be readily attached and detached and which, when deployed, would control the position of the button so as to prevent the button from translating and from twisting or turning.

SUMMARY OF THE INVENTION

The present invention successfully addresses the shortcomings of the presently known configurations by providing means capable of effecting the detachable mounting of a button or other pin-mounted ornament having a pin onto a piece of jewelry. The device according to the present invention has a base having a rear surface which is connected to the piece of jewelry. Connected to the base are side walls which define a depressed volume. Located in the side walls are one or more pairs of oppositely oriented perforations through which the pin of the ornament or button can be inserted.

More specifically, the device according to the present invention can be connected to, or can form an integral part of, a jewelry item. The device is attached to the jewelry item through its base. Protruding from the base are side walls through which one or more opposing pairs of perforations are located. Each such opposing pairs of perforations can accommodate a pin, such as the pin typically found attached to the back surface of many ornaments such as display buttons, whether political, motivational, or ornamental.

While the device of the present invention can be conveniently used in conjunction with earrings, bracelets, tie clips, etc., it is most preferable to use the device according to the present invention in conjunction with finger rings, particularly inexpensive costume jewelry rings. While the ornament to be attached to the piece of jewelry can be any ornament having a pin as its means of mounting, it is preferable to use the device according to the present invention to detachably mount display buttons, such as political buttons, motivational buttons, or ornamental buttons.

The device according to the present invention can be made of any convenient material or materials, preferably the device will be constructed of the same material as the piece of jewelry to which it attaches.

The device according to the present invention could be used as follows: The user would purchase a jewelry item containing the device according to the present invention, for example, a properly modified ring with a proper modification. The user would then mount onto the ring a display button. After wearing the ring in this manner for a time, the user, wishing to change the button, would unclasp the pin of the button presently mounted onto his or her ring and pull the pin out so as to disengage it from the device of the present invention. The user would then insert into an opposing pair of perforations another pin onto which is mounted a different button. Following the insertion of the pin, the user would clasp the end of the pin to complete the mounting of the new button onto the ring. In this manner the button or ornamental portion could be changed readily or easily at the will of the user, giving the jewelry item a different appearance while obviating the need to own and store a large selection of rings.

BRIEF DESCRIPTION OF THE DRAWINGS

The above and other embodiments of the present invention may be more fully understood from the following detailed description when taken together with the accompanying drawings wherein similar reference characters refer to similar elements throughout and in which.

DESCRIPTION OF THE PREFERRED EMBODIMENTS

The present invention is of a device connected to a jewelry item which makes it possible to detachably mount onto the jewelry item an ornament such as a display button which includes a pin as its means of attachment.

Figure 1:
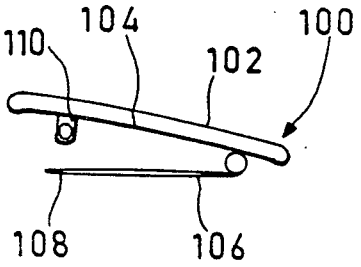
FIG. 1 is a side view of a typical commonly-encountered display button of the kind which could be detachably mounted onto the device according to the present invention.

Referring now to the drawing, FIG. 1 illustrates one type of ornament which can be attached to a piece of jewelry using the device of the present invention. FIG. 1 shows a typical display button generally designated as 100, such as a political button, a motivational button, or a decorative button. The button features a front surface 102 on which there is displayed a message or pattern of some sort. Button 100 is easily constructed of thin sheet metal and is typically hollow on the inside. Button 100 has a back surface 104 which typically serves to contain a portion of the attachment mechanism. The attachment mechanism resembles a common safety pin. One portion of the attachment mechanism, the pin 106 lies essentially parallel to the button back surface 104. One end of pin 106 is the sharpened point 108. The other end of the pin 106 is made to change directions and enter the hollow space between the button front surface 102 and the button back surface 104 This hidden portion of the attachment mechanism is connected to a clasp 110 which protrudes from button back surface 104 and serves to secure pin 106 when the securement mechanism is deployed. It is thus seen that pin 106 is permanently attached to button 100, i.e., pin 106 cannot be separated from button 100 without damaging button 100.

Figure 2:
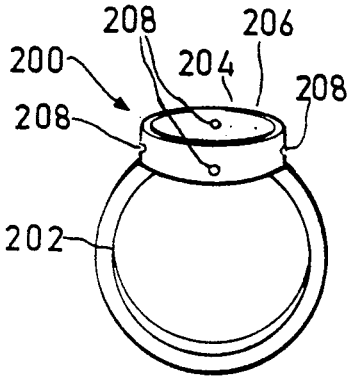
FIG. 2 is a ring which has been modified to include the device according to the present invention.

Shown in FIG. 2 is one embodiment of the device according to the present invention, generally designated as 200. The device, according to the present invention, can be used in conjunction with any piece of jewelry such as a ring, an earring, or bracelet. The jewelry used can be one made of precious metals and/or gem stones or it could be inexpensive costume jewelry such as might be worn by children and teenagers.

The device of the present invention 200 can be permanently attached to the piece of jewelry or can be connected to the piece of jewelry in some other convenient fashion. Shown in FIG. 2 is the device of the present invention 200 permanently connected to or integrally a part of a finger ring 202. Device 200 includes a base 204 which is connected to ring 202. Connected to base 204 are side walls 206. Side walls 206 may project from ring 202 perpendicularly or substantially perpendicularly, or may project at any convenient angle. Side walls 206 may be a single cylindrical wall or may be a number of connected or partially connected side walls of any shape or configuration. For example, side walls 206 may consist of a triangular or square configuration. Side walls 206 may even be one or more pairs of studs protruding from base 204. Most preferably, side walls 206 would extend substantially perpendicularly from ring 202 and form a singular circular wall. Side walls 206 contain at least one pair of opposing perforations 208.

Perforations 208 are sized and shaped so as to comfortably accommodate pin 106 commonly used in conjunction with display buttons and other ornaments. Perforations 208 should not be so large as to permit pin 106 to freely move within the perforations. Perforations 208 can be oriented in any convenient fashion, preferably perforations 208 should be oriented so that, when pin 106 is inserted into a pair of opposing perforations 208, such pin 106 is oriented either perpendicular to or parallel with the plane of ring 202. Preferably, at least two pairs of perforations 208 are, one oriented parallel to the plane of ring 202 and one oriented perpendicular to the plane of ring 202. The inclusion of two such pairs of perforations 208 will ensure that button 100 can be oriented either parallel to or perpendicular to ring 202 as desired by the user. In other embodiments (not shown) the perforations may be lined with a plastic or rubber material to provide additional friction. The perforations may also contain additional devices for catching and immobilizing pin 106, such as earring backs.

Figure 7:
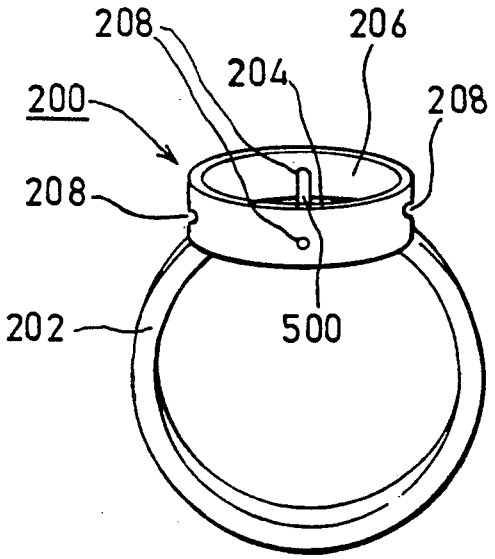
FIG. 7 shows another embodiment as in FIG. 2 but including a tube connecting an opposed pair of perforations.

Shown in FIG. 7 is another embodiment wherein opposed pairs of perforations 208 are connected to each other by tubes 500.

Figure 3:
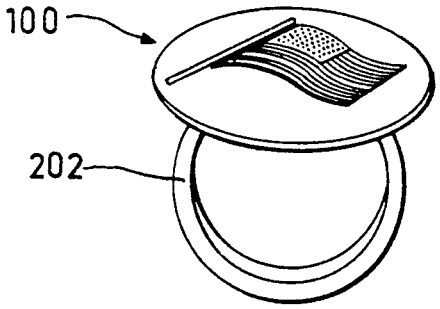
FIG. 3 is a perspective drawing showing a button as in FIG. 1 mounted onto the modified ring of FIG. 2.

Shown in FIG. 3 is ring 202 with button 100 mounted onto ring 202 with the help of the device according to the present invention (not shown).

Figure 4:
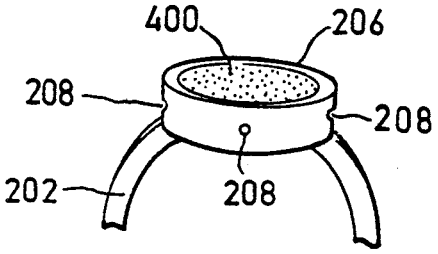
FIG. 4 shows an alternative embodiment of the device shown in FIG. 2 further including a cover plate.

Shown in FIG. 4 is another embodiment of the device according to the present invention. The device is similar to the device shown in FIG. 2 but, in addition, contains a cover plate 400 attached to side walls 206. Cover plate 400 serves to substantially enclose a volume formed by the base 204 and side walls 206. One of the reasons why it may be desirable to include cover plate 400 is for aesthetic considerations, namely, cover plate 400 can be used to display a trademark or other ornamental figure which will enable the ring to be worn with pleasing aesthetic effect even in the absence of button 100.

A second and perhaps more important reason for including cover plate 400 is that the inclusion of cover plate 400 substantially encloses a hollow volume extending between base 204, side walls 206, and cover plate 400. Such a volume can be substantially filled with a suitable material such as a rubber or a plastic. The filling can be accomplished by injection of molten rubber or molten plastic through one of perforations 208. Upon cooling, the molten rubber or plastic hardens and sets, essentially filling the volume. The purpose of filling the volume with such material is to further stabilize pin 106 when it is inserted into a perforation and out the opposing perforation. By forcing the pin to be inserted through a rubber or plastic body, it is possible to immobilize the pin so as to prevent pin 106 from rotating translating along, or rotating about its axis, thereby Causing button front surface 102 and its included display to move. While the presence of cover plate 400 facilitates the introduction of rubber or plastic into the device, rubber or plastic can also be used even in the absence of cover plate 400, for example, in the embodiment of FIG. 2. In such a case the rubber of plastic will be attached to the device using some convenient means, such as gluing.

Figure 5:
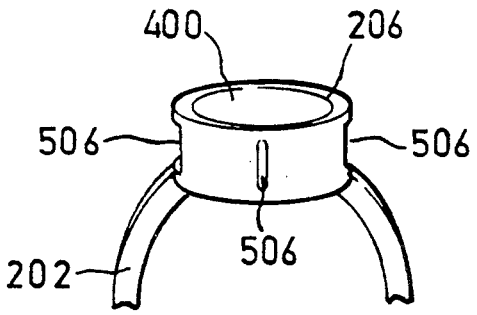
FIG. 5 shows another embodiment of the device according to the present invention showing slitted perforations rather than holes.
Figure 6:
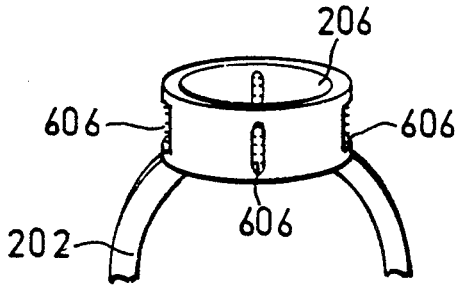
FIG. 6 shows another embodiment having slits as in FIG. 5 but wherein the slit edges are serrated.

Shown in FIGS. 5 and 6 are further embodiments of the device according to the present invention. It is highly desirable to provide a device which will tend to immobilize button 100 so as to prevent button 100 from moving either along, or from rotating about, the axis of pin 106. This objective can be achieved by modifying the embodiment shown in FIG. 4 by replacing perforations 208 with elongated perforations 506 of a width approximately equal to the diameter of perforations 208 and which extend in a direction between base 204 and cover plate 400. The hollow space between base 204, cover plate 400, and side walls 206 would still be filled with a rubber or plastic material. The presence of elongated perforations 506 makes it possible to insert pin 106 in precisely the location which will put the upper edges of side walls 206 in contact with button back surface 104 once pin 106 has been secured by clasp 110. The contact between button back surface 104 and cover plate 400 will tend to stabilize button 100 and prevent it from translating along or rotating about pin 106.

A further modification of the embodiment shown in FIG. 5 is shown in FIG. 6 wherein the elongated perforations 506 have been replaced with serrated elongated perforations 606 featuring a series of pairs of opposing extension members located approximately one pin diameter apart in the longitudinal direction. The presence of the extension member would tend to better retain and immobilize pin 106.

To deploy the device according to the present invention, the user would select a button or other pin-mounted ornament. The user would unclasp the pin or the button. The user would then insert the sharpened end of the pin through one of the perforations of the device. The insertion would be made at the location which would ideally render the button properly oriented and also which would cause the back surface of the button to be in contact with the top surface or cover plate of the device. The user would push the pin through the initial perforation, through the rubber or plastic material contained within the device, and out the opposing perforation. The user would then maneuver the pin so it is retained by the clasp located on the button. This would complete the mounting of the button onto the ring. When it is desirable to change buttons, the user would unclasp the pin, pull the pin out through the two perforations and the rubber or plastic material, and would then replace the button with a new button using the procedure similar to that described above.

To one ordinarily skilled in the art, it will be clear the present invention is not limited to use in connection with costume jewelry rings but rather can be used whenever it is desired to detachably mount a pinattached ornament of any type, onto jewelry of any type, whether expensive or inexpensive, precious metal or costume, whether rings, earrings, brooches, or bracelets, etc.

It is seen that the present invention and the embodiments disclosed herein are well adapted to carry out the objectives and obtain the ends set forth at the outset. Certain changes can be made in the method without departing from the spirit and the scope of this invention. It is realized that changes are possible and it is further intended that each element recited in any of the following claims is to be understood as referring to all equivalent elements for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

Those skilled in the art may find many variations and adaptations thereof, and all such variations and adaptations, falling within the true scope and spirit of applicant's invention, are intended to be covered thereby.

What is claimed is:

1. An article, comprising:

(a) an ornament having a permanently attached pin;

(b) a piece of jewelry; and (c) a device for effecting the detachable mounting of said ornament onto said piece of jewelry, said device including:

(1) a base having a rear surface connected to said piece of jewelry;

(2) side walls connected to said base, said side walls defining a depressed volume therebetween; and (3) an opposed pair of perforations in said side walls, said pair of perforations capable of accommodating said permanently attached pin of said ornament.

2. An article as in claim 1 wherein said opposed pair of perforations is oriented such that said pin inserted into said perforations is oriented substantially in the plane of said piece of jewelry.

3. An article as in claim 1 wherein said opposed pair of perforations is oriented such that said pin inserted into said perforations is oriented substantially perpendicular to the plane of said piece of jewelry.

4. An article as in claim 1 wherein said opposed pair of perforations is oriented substantially perpendicular to the plane of said piece of jewelry.

5. An article as in claim 1 wherein said opposed pair of perforations are elongated in a direction away from said piece of jewelry.

6. An article as in claim 5 wherein said opposed pair of perforations include means for accommodating said pin at various distances from said piece of jewelry.

7. An article as in claim 1, wherein said device for effecting the detachable mounting of said ornament onto said piece of jewelry further includes:

a cover plate connected to said side walls, said cover plate substantially enclosing said depressed volume.

8. An article as in claim 7 wherein said depressed volume includes a rigid, solid or resilient material providing friction, through which material said pin moves during attachment or detachment.

9. An article as in claim 1, wherein said device for effecting the detachable mounting of said ornament onto said piece of jewelry further includes:

a tube connecting said opposed pair of perforations.

10. An article as in claim 9 wherein said tube includes a rigid, solid or resilient material providing friction, through which material said pin moves during attachment or detachment.

11. An article as in claim 1 wherein said depressed volume includes a rigid, solid or resilient material providing friction, through which material said pin moves during attachment or detachment.

12. An article, comprising:

(a) an ornament having a permanently attached pin;

(b) a ring member;

(c) a device for effecting the detachable mounting of said ornament onto said ring member, said device including:

(1) a base having a rear surface connected to said ring member;

(2) side walls connected to said base, said side walls defining a depressed volume therebetween; and (3) an opposed pair of perforations in said side walls, said pair of perforations capable of accommodating said permanently attached pin of said ornament.

* * * * *